US005271422A

United States Patent [19]

Sorrell et al.

[11] Patent Number: 5,271,422

[45] Date of Patent: Dec. 21, 1993

[54] SAFETY WALKER

[76] Inventors: Michael R. Sorrell, 5 Chatham Rd., Longmeadow, Mass. 01106; Simon Slootsky, 125 Allen Park Rd., Springfield, Mass. 01118

[21] Appl. No.: 652,492

[22] Filed: Dec. 11, 1990

[51] Int. Cl.[5] ..... A45B 3/00

[52] U.S. Cl. ..... 135/66; 135/67; 297/5; 297/45; 297/481

[58] Field of Search ..... 135/67, 72, 74; 272/70 A, 70.3; 297/5, 6, 45, 487, 488

[56] References Cited

U.S. PATENT DOCUMENTS

| | | | |
|---|---|---|---|
| 2,592,879 | 4/1952 | Eyerly | 297/487 |
| 3,354,893 | 11/1967 | Schmerl | 272/70.3 X |
| 3,516,425 | 6/1970 | Rigal | 135/67 |
| 4,481,965 | 11/1984 | Watkins | 135/74 X |
| 4,621,804 | 11/1986 | Mueller | 135/67 X |
| 4,700,730 | 10/1987 | Samuelson et al. | 135/67 |
| 4,801,176 | 1/1989 | Wolberg | 297/45 X |
| 4,826,241 | 5/1989 | Barras | 297/45 X |

FOREIGN PATENT DOCUMENTS

| | | | |
|---|---|---|---|
| 1093949 | 1/1981 | Canada | 272/70.3 |
| 0229445 | 7/1987 | European Pat. Off. | 272/70.3 |
| 2154149 | 9/1985 | United Kingdom | 272/70.3 |

*Primary Examiner*—Carl D. Friedman
*Assistant Examiner*—Lan M. Mai
*Attorney, Agent, or Firm*—Donald S. Holland

[57] ABSTRACT

A foldable rigid frame front entry safety walker having programmed resistance to backward motion, and having a porous seat to accommodate incontinent patients.

1 Claim, 6 Drawing Sheets

SAFETY WALKER

DESCRIPTION

1. Technical Field

This invention relates to safety walkers for medical patients, such as those with Parkinson's Disease, and in particular to walkers having resistance to backward falls and injury avoidance in the event of a backward fall.

2. Background Art

Patients with Parkinson's Disease, multiple cerebral infarcts, orthopedic and arthritic afflictions of the legs and feet, and other similar conditions frequently tilt, shuffle, stumble and fall as a result of diseases of bone, joint, and nervous systems. Walkers comprised of two side frames with front and back legs, a front brace, and plain or wheeled leg tips allow the disabled to walk. Although most modern walkers have height adjustable legs, light weight, and stable construction, they are not useful for the patient who falls backwards. Patient with Parkinson's Disease, hydrocephalus, multiple small strokes, and other neurologic conditions effecting the basal ganglia, ventricular system, and the long motor tracts bordering the ventricles of the brain have a defect of the righting reflex. Those afflicted often stumble backwards, retropulse, either spontaneously or in response to a minor stimulus. They also stumble when turning. Patients with bony deformities of the legs and feet can also fall backwards uncontrollably from mechanical disadvantage. There are no previous walkers that effectively prevent the patient from falling backwards. The basic service of this safety walker is to prevent the retropulsing patient from falling backwards, causing serious injury.

Current safety walkers are described by U.S. Pat Nos. 4,298,016 (Garelick), 4,532,948 (Burrows), 4,703,769 (Harrison), and 4,800,910 (Gamm). None of these walkers, nor do any of current walkers, provide the safety features to prevent injurious falls to patients as provided by our invention.

DISCLOSURE OF INVENTION

None of the current walkers provide a structure to accommodate the safety features and ease of use of our safety walker. These features include:

a) Front entrance;
b) Resistance to injury caused by backward fall;
c) Resistance to forward fall;
d) Programmed resistance to backward rolling motion;
e) A porous seat placed behind the patient for resting and to accommodate incontinent patients;
f) comfortable and effective environment to patient actuated forward motion; and
g) Unique folding method for ease of carrying and storage.

None of the present walkers provide those features, nor even an effective combination of most of these features, in an effective structure.

Backward falls are the most dangerous events when patients use a walker. When a patient falls or steps backwards, he or she must be stopped by an object which will not flip over once it has met the force of the falling body. The forward edge of our safety walker's seat will induce the patient's knees to buckle upon contact, causing the patient to sit in the mesh seat. If the patient's knees do not buckle, his or her shoulders, neck, or head may be caught by the top edge of the seat. Even if the patient remains in board-like rigidity, our safety walker will catch the body and will not flip over, because the rear legs are bent backwards at an angle which resists the force of the falling body.

Some walkers, such as those described by U.S. Pat. No. 4,532,948 have a seat to provide a portable resting place for the patient. To use the seat, the patient has to turn around or bring the walker behind him or her. Our safety walker has a seat directly behind the patient. Therefore, the patient can sit down in a natural, safe movement, avoiding further risk of falling. Our seat may be made of a non-absorbing mesh since patients may be incontinent of urine or feces.

The patient enters from the rear of a standard walker, which precludes the use of our safety features. The patient enters our safety walker from the front by swinging the front stabilizing bar up and to the side like a gate hinged with a universal joint. Once in, the patient can clamp and secure the front stabilizing bar to the opposite side bar by a spring lock.

To provide stability and a hand-grasp, prior walkers have handles which project backwards from the top of the front legs or from the front or side stabilizing bars, as in U.S. Pat. No. 4,800,910. To save space and to accommodate the moving front bar more easily, this safety walker's handles face forward. The patient, therefore, stands further forward in this safety walker than in standard walkers. The lower portion of the front legs are bent forward to provide structural stability in case the patient falls forward.

Any structure might tip over if enough torque forces the object to rotate on the fulcrum of a fixed point. The rolling of the rear wheel not only enables this walker to move forward easily, it also baffles the initial force of the patient's backward movement before it brakes in its housing.

While the preferred embodiment of our safety walker is a fixed structure, we also provide an embodiment with a collapsible structure. Unlike walkers such as described by U.S. Pat. No. 4,298,016 which fold exclusively at the corners, our collapsible model folds both at the corners and in the middle of the side and rear stabilizing bars. The front stabilizing bar swings to lay next to the right side of this walker. The folding model should be flat when folded and light enough to carry with one arm.

DESCRIPTION OF PREFERRED EMBODIMENT

Figure 1:
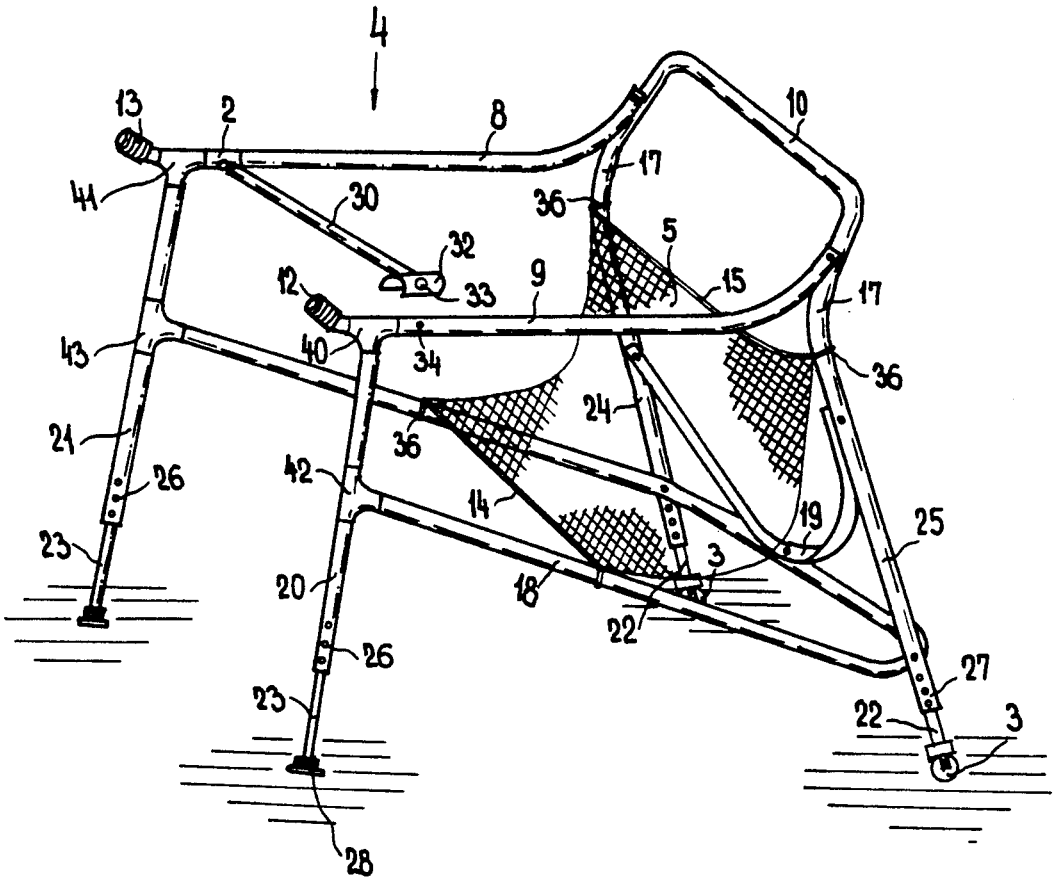
FIG. 1 is a perspective view of the safety walker.

FIG. 1 is a perspective view of the walker 4 having a flexible mesh seat 5. The walker has tubular parallel side frames 8 and 9 of similar strength plastic or metal connected by screw or plastic bonding to an open ended rectangular rear frame 10 which is bent at radius 17 to form to rear legs 24 and 25. Note the top of rear frame 10 is bent away from the patient. An open ended rectangular frame bar 18 connects to front legs 20 and 21 by slightly angulated T-joints 42 and 43 and to the rear frame 10 by screws or plastic bonds providing structural strength. The upper horizontal segment of rear frame 10 constitutes the rear upper cross member of the walker structure. The rear segment of frame bar 18 between rear legs 24 and 25 constitutes the rear lower cross member of the walker structure. A U-shaped bar 19 bridges the rear legs 24 and 25 and the lower bar 18, it is connected by screw or plastic bond at each contact site. Front legs 20 and 21 connect to side frames 8 and 9 by T-joints 40 and 41. Handles 12 and 13 extend up and in from side bars 8 and 9.

Tubular sections fit into the lower ends of the front leg 23 and rear leg 22 fastening by spring loaded buttons through front 26 and rear 27 holes to provide height adjustments. Rubber or plastic cups 28 cover the bottom tips of tubular extensions 23 of the front legs.

Figure 2A:
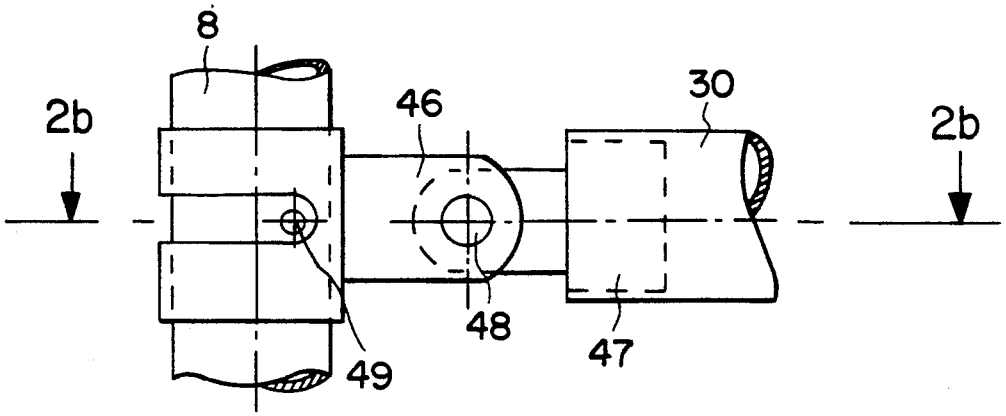
FIG. 2*a* is a top view of the universal joint of the gate mechanism.
Figure 2B:
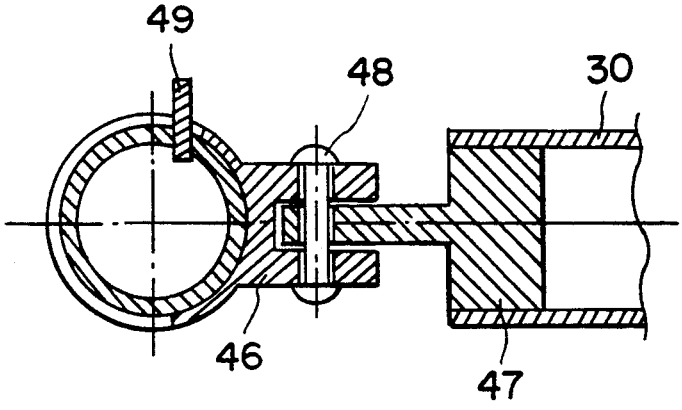
FIG. 2*b* is a front cross-sectional view of the joint shown in FIG. 2*a*. A—A is the axis of symmetry.

A cross beam 30, also referred to as the front upper cross member when this beam is in a closed and locked position, rotates at universal joint 2 allowing entrance to he walker. FIGS. 2*a* and 2*b* illustrate the joint which enables the cross beam to rotate up, down, or sideways. Tubular coupling 46 overlaps sidebar 8; it is secured by pin 49. Tubular coupling 47, bonded and fitting inside crossbar 30, is joined to couple 46 by stamped pin 48.

Figure 3A:
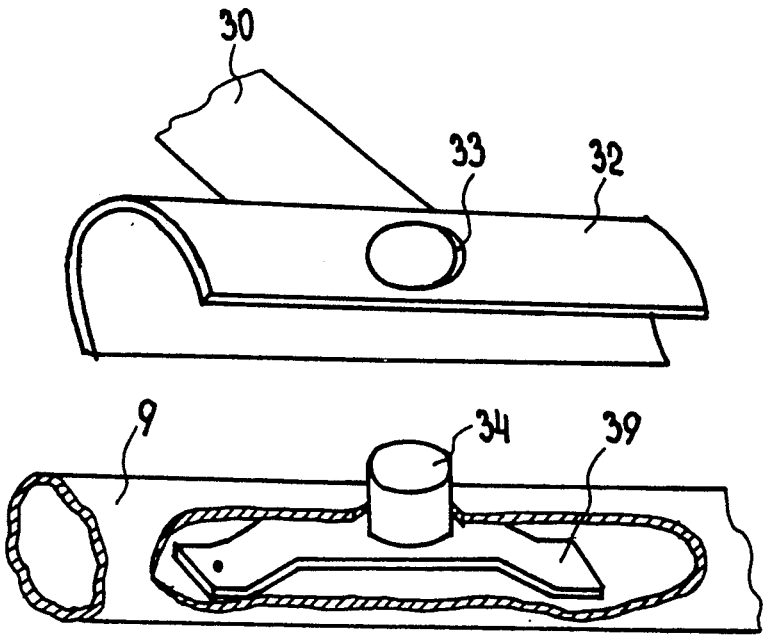
FIG. 3*a* is a side view of the spring loaded clamp for gate closure when opened.
Figure 3B:
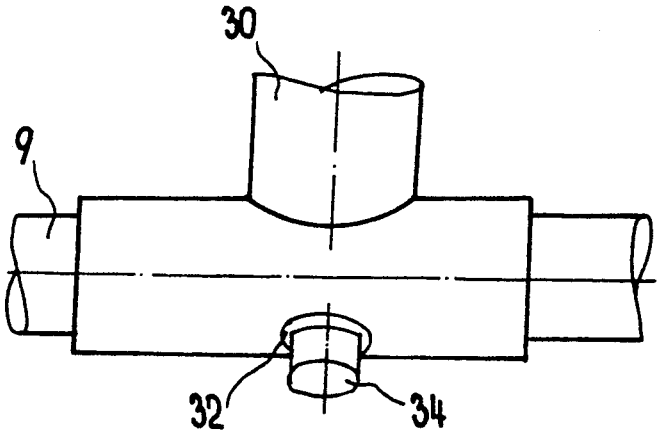
FIG. 3*b* is a top view of the gate closure pictured in 3*a* in a locked position.

An arc shaped plate 32, shown in FIGS. 3*a* and 3*b* secures the other end of bar 30 to side bar 9 by a spring lock comprised of a bent metal or plastic plate 39 and extension plug 34 through the hole 33. The plug 34 tilts at a 10 o'clock position.

Figure 4A:
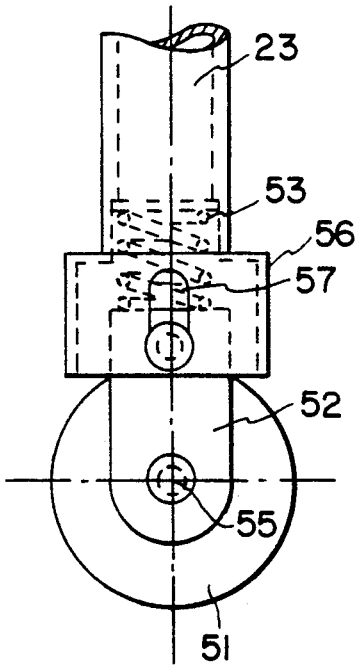
FIG. 4*a* is a side view of the rear wheel housing.
Figure 4B:
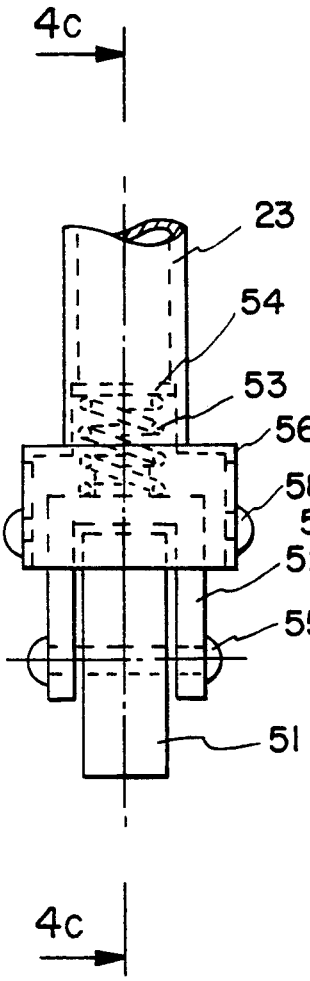
FIG. 4*b* is a rear view of the rear wheel housing.
Figure 4C:
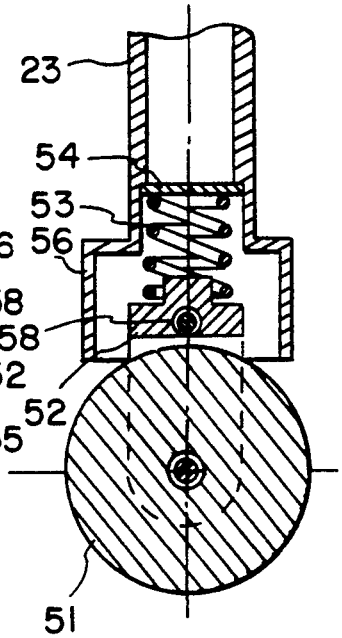
FIG. 4*c* is a cross sectional side view of the rear wheel housing. B—B is the axis of symmetry.

FIGS. 4*a*, 4*b*, and 4*c* illustrate the rear wheel mechanism 3. Polyurethane (or similar material) 2 inch diameter wheels 51 connect inside the 1¾ inch wheel housing 56 by U-shaped holder 52. Spring 53 sits on top of U-shaped holder 52 and is fitted to the lower end of leg 23 by washer 54. Wheel axle 55 secures wheel 51 in holder 52; plug 57 extending upward from holder 52 fits inside spring 53. Pin 58 extends through holder 52 to protrude at the sides of housing 56. The gauge of spring 53 can be altered so that, for example, 40 or more pounds of force caused by the patient going backwards shortens spring 53, forces wheel housing 56 down on wheel 51, and produces enough friction at the contacting edges to stop wheel rotation and brake the walker.

Referring again to FIG. 1, seat 5 is made of a flexible mesh material which should be impervious to urine and feces. Sewing switches, reinforces by firm but flexible material at the forward 14 and upper 15 edges provide stability to the seat and resistance to body parts striking the seat. Four O-clips 36 hold the seating material to the lower side frame 18 and rear legs 24 and 25. The forward edge of the seat should be adjusted to the height of the patient's popliteal fossae to induce a sitting movement once the patient stumbles backwards into it. The bottom of the seat should be high enough to allow the patient to stand up with as little effort as possible.

Figure 5A:
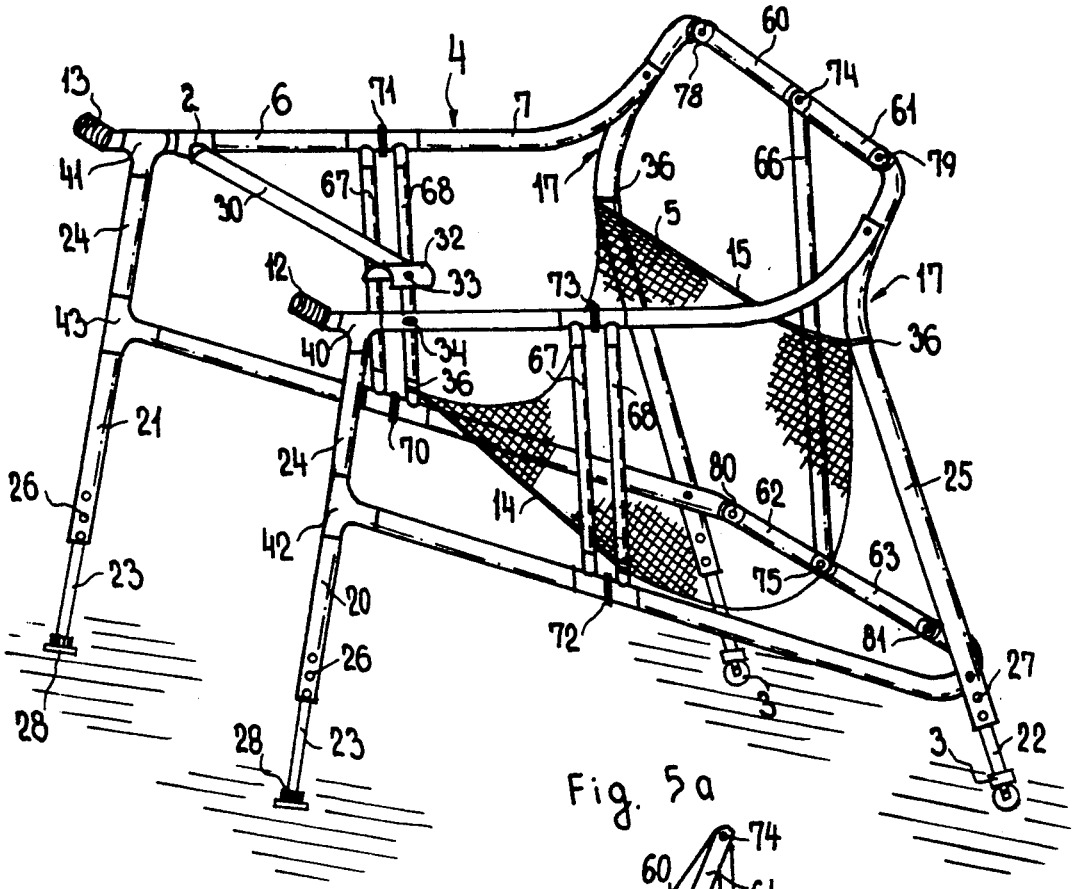
FIG. 5*a* is a perspective view of the collapsible model of the safety walker in the open position.
Figure 5B:
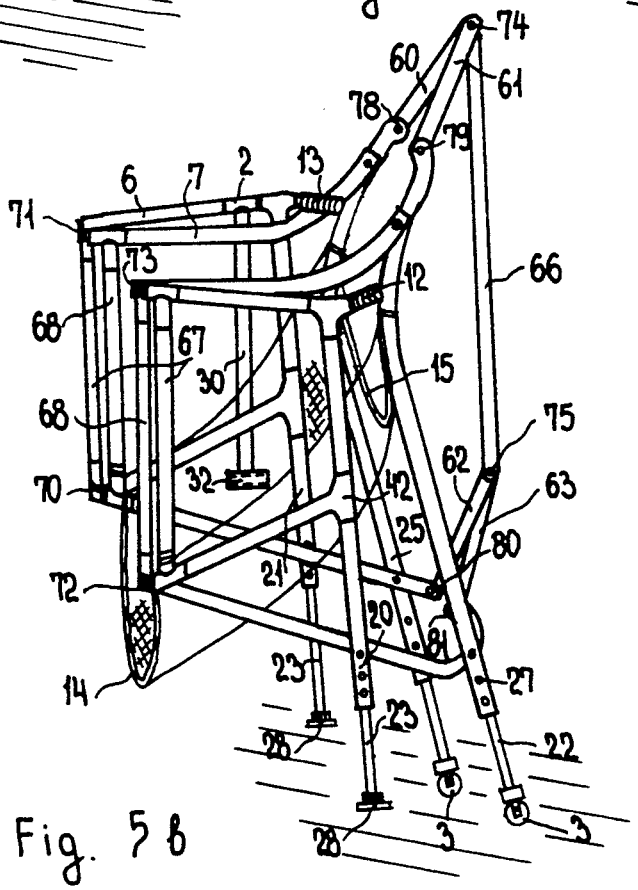
FIG. 5*b* is a side view of the collapsible model of the safety walker in the folded position.
Figure 6:
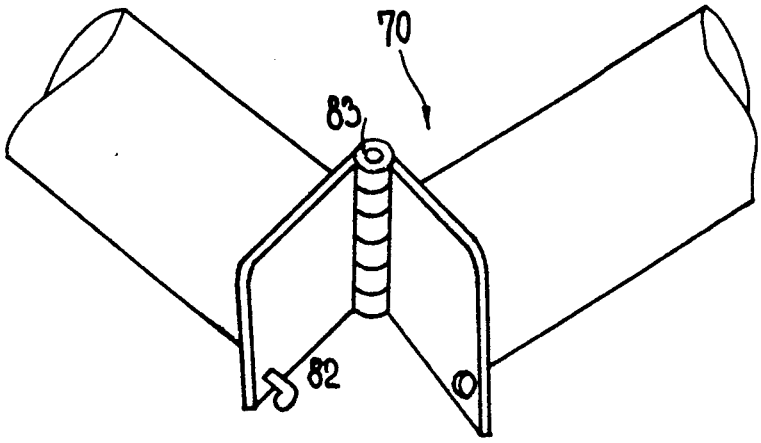
FIG. 6 is a perspective view of the joint enabling the side bars to fold.
Figure 7:
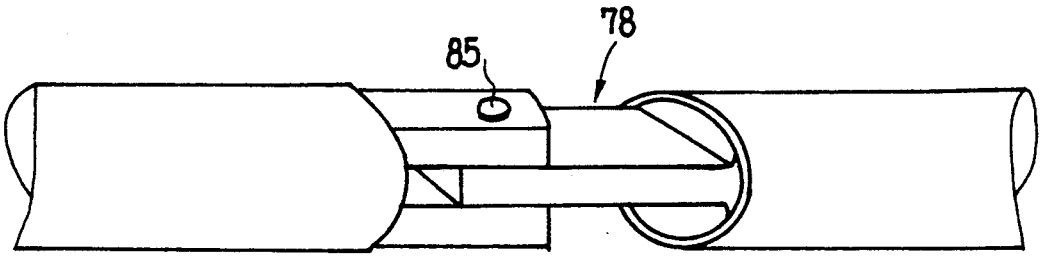
FIG. 7 is a side view of the joint which enables the rear bars to fold at their sides.
Figure 8:
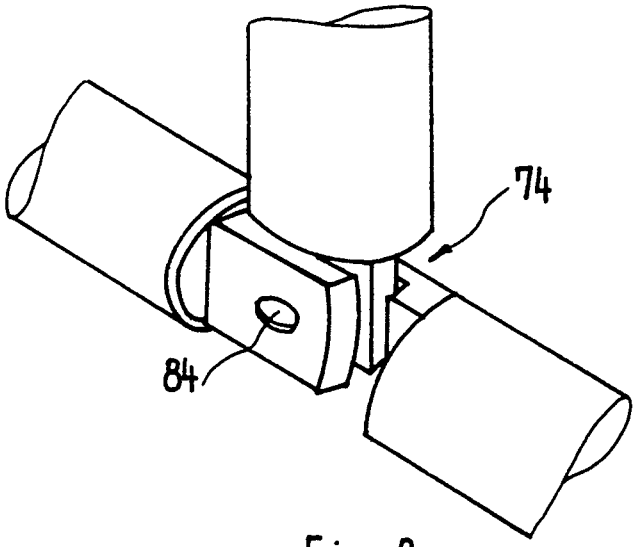
FIG. 8 is a perspective view of the joint which enables the rear bars to fold in the middle.

FIGS. 5*a* and 5*b* illustrate the open and folded collapsible model of this safety walker. To fold the walker, the operator disengages the clamp 32, rotates bar 30 so it rests on the outside aspect of lower frame bar 18, and disengages the spring latch hook(s) 82 on identical folding joint(s) 70 and 71 on the right as illustrated by FIG. 6. Joints 72 and 73 on the left are mirror images of joints 70 and 71 and all joints open at hinge 83. After folding the front sections 6 back into the rear sections 7, the operator disengages the two central folding joints 74 and 75 shown by FIG. 8 moving around stamped pin 84. This movement enable rear sections 60, 61, 62, and 63 to swing up by hinging at joints 78, 79, 80, and 81 around stamped pin 85, as shown by FIG. 7. The upward movement of the rear pieces allows the sides to come together, making the walker almost flat. To open the walker, the operator reverses the entire procedure.

The general dimensions of the walker will vary depending on the size of the patient.

We claim:

1. A front entry rigid frame walker comprising:

A rear frame having a rear left leg and a rear right leg; Two side frames each having a front leg;

said side frames being rigidly connected by a front entry lockable hinged gate and a rear upper cross member, and a rear lower cross member;

each of said front legs extending downward and forward;

each of said rear legs extending downward and backwards;

a seat being connected to said side and rear frames;

a skid resistant member attached to the bottoms of said front legs;

wheels having programmed resistance to rolling attached to the bottoms of said rear legs, wherein said programmed resistance of said wheels comprises a spring loaded brake pad that exerts pressure on said wheels as a function of the downward force applied to said rear support legs;

one lockable hinge joint centered on the top of each side frame, and one lockable hinge joint centered on the bottom of each side frame, to facilitate outward and rearward folding of the front sections of said side frames by unlocking said lockable hinged joints;

two hinged joints near the ends and one lockable hinged joint near the middle of said top cross member, two hinged joints near the ends and one lockable hinge joint near the middle of said bottom cross member, and a vertical member connected to said lockable hinged joints at the center of said cross members, to facilitate folding of said cross members by unlocking said hinged joints and raising said vertical member.

* * * * *